US011171442B2

(12) United States Patent
Ishikawa et al.

(10) Patent No.: US 11,171,442 B2
(45) Date of Patent: Nov. 9, 2021

(54) HOUSING

(71) Applicant: YAZAKI CORPORATION, Tokyo (JP)

(72) Inventors: Yoshinori Ishikawa, Makinohara (JP); Tomomi Endo, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/843,359

(22) Filed: Apr. 8, 2020

(65) Prior Publication Data

US 2020/0373705 A1 Nov. 26, 2020

(30) Foreign Application Priority Data

May 20, 2019 (JP) ..... JP2019-094683

(51) Int. Cl.

| | |
|---|---|
| ***H01R 13/52*** | (2006.01) |
| ***H01R 13/627*** | (2006.01) |
| ***H01R 13/629*** | (2006.01) |
| ***H01R 13/516*** | (2006.01) |
| ***H01R 9/24*** | (2006.01) |
| ***H01R 13/502*** | (2006.01) |
| ***H01R 43/20*** | (2006.01) |

(52) U.S. Cl.

CPC ..... *H01R 13/521* (2013.01); *H01R 9/2458* (2013.01); *H01R 13/502* (2013.01); *H01R 13/516* (2013.01); *H01R 13/627* (2013.01); *H01R 13/629* (2013.01); *H01R 43/20* (2013.01)

(58) Field of Classification Search

CPC .. H01R 13/521; H01R 13/502; H01R 13/516; H01R 13/627; H01R 9/5428

USPC ..... 439/587

See application file for complete search history.

(56) References Cited

U.S. PATENT DOCUMENTS

| | | | | |
|---|---|---|---|---|
| 5,330,362 | A | 7/1994 | Ito et al. | |
| 6,905,355 | B2 * | 6/2005 | Fukamachi | H01R 13/62933 439/157 |
| 7,618,271 | B2 * | 11/2009 | Shiga | H01R 13/62977 439/157 |
| 2005/0221653 | A1 * | 10/2005 | Dillon | H01R 13/62977 439/331 |

(Continued)

FOREIGN PATENT DOCUMENTS

| | | | |
|---|---|---|---|
| JP | H05-81965 | U | 11/1993 |
| JP | 2006-24458 | A | 1/2006 |

(Continued)

*Primary Examiner* — Alexander Gilman

(74) *Attorney, Agent, or Firm* — Sughrue Mion, PLLC

(57) ABSTRACT

A housing is configured to be fitted to a mating housing, the housing including a cylindrical hood into which a fitting protrusion of the mating housing is fittable, the cylindrical hood being configured such that, when the fitting protrusion is fitted into the cylindrical hood, a space between the cylindrical hood and the fitting protrusion is sealed with an annular seal member provided on the fitting protrusion. The cylindrical hood includes, at a distal end of the cylindrical hood from which the housing is fitted to the mating housing, a cylindrical seal portion configured to contact, when the fitting protrusion is fitted into the cylindrical hood, an edge of the mating housing continuously over an entire circumference of the edge and to cover the edge between the cylindrical seal portion and the edge.

2 Claims, 11 Drawing Sheets

(56) References Cited

U.S. PATENT DOCUMENTS

| | | | | |
|---|---|---|---|---|
| 2006/0009058 | A1 | 1/2006 | Nagano et al. | |
| 2006/0040535 | A1* | 2/2006 | Koshy | H01R 13/62977 439/157 |
| 2010/0081313 | A1* | 4/2010 | Komiyama | H01R 13/62977 439/341 |
| 2011/0237109 | A1* | 9/2011 | Komiyama | H01R 13/62977 439/345 |
| 2011/0312198 | A1* | 12/2011 | Komiyama | H01R 13/62911 439/157 |
| 2014/0242820 | A1* | 8/2014 | Suzuki | H01R 13/5208 439/157 |
| 2016/0156130 | A1 | 6/2016 | Sekino | |

FOREIGN PATENT DOCUMENTS

| | | | |
|---|---|---|---|
| JP | 2006-185875 | A | 7/2006 |
| JP | 2016-105353 | A | 6/2016 |
| JP | 2016115411 | A | 6/2016 |
| WO | 2018/088060 | A1 | 5/2018 |

* cited by examiner

HOUSING

CROSS-REFERENCE TO RELATED APPLICATION

The present application claims priority to Japanese Patent Application No. 2019-094683 filed on May 20, 2019, the entire content of which is incorporated herein by reference.

TECHNICAL FIELD

The present invention relates to a housing.

BACKGROUND

A related art connector in which housings are fitted and connected to each other includes an annular seal member which is a packing or the like that seals a portion at which the housings are fitted to each other and prevents water from entering a space inside the housings in which terminals are connected to each other (for example, see JP2016-105353A and JP2016-115411A).

However, when a vehicle is washed with a high water pressure cleaner or the like, water ejected at a high pressure from the high pressure cleaner may hit the housings and enter a gap between the housings of the connector mounted on the vehicle. As a result, an inner seal member may be damaged and sealing performance may be reduced due to the water ejected at such a high pressure.

SUMMARY

Illustrative aspects of the present invention provide a housing configured to maintain good sealing performance between the housing and a mating housing fitted to the housing.

According to an illustrative aspect of the present invention, a housing is configured to be fitted to a mating housing, the housing including a cylindrical hood into which a fitting protrusion of the mating housing is liftable, the cylindrical hood being configured such that, when the fitting protrusion is fitted into the cylindrical hood, a space between the cylindrical hood and the fitting protrusion is sealed with an annular seal member provided on the fitting protrusion. The cylindrical hood includes, at a distal end of the cylindrical hood from which the housing is fitted to the mating housing, a cylindrical seal portion configured to contact, when the fitting protrusion is fitted into the cylindrical hood, an edge of the mating housing continuously over an entire circumference of the edge and to cover the edge between the cylindrical seal portion and the edge.

Other aspects and advantages of the invention will be apparent from the following description, the drawings and the claims.

BRIEF DESCRIPTION OF THE DRAWINGS

FIGS. 4A and 4B illustrate the male housing according to the present embodiment, in which FIG. 4A is a front view, and FIG. 4B is a side view;

FIGS. 6A and 6B illustrate the female housing, in which FIG. 6A is a front view, and FIG. 6B is a side view;

DETAILED DESCRIPTION

Figure 1:
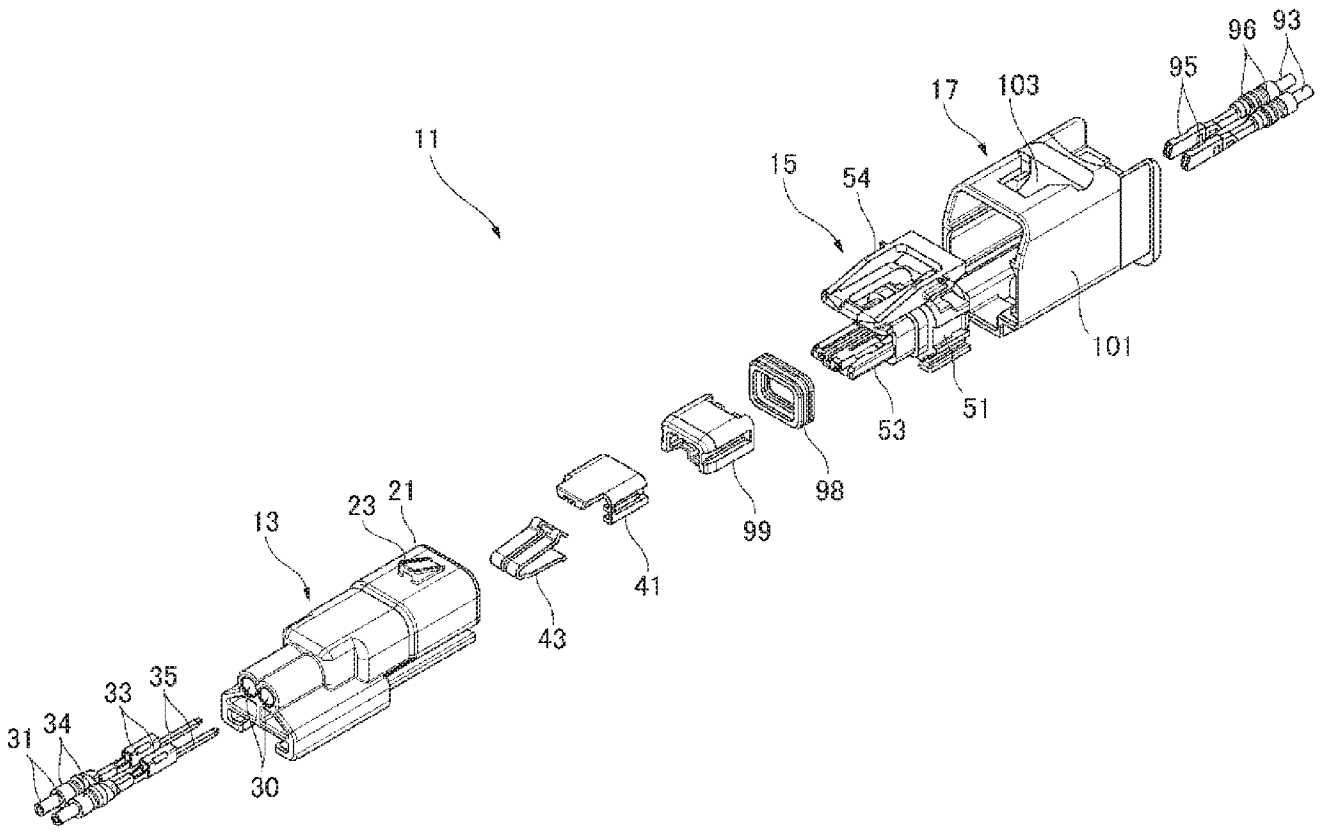
FIG. 1 is an exploded perspective view of a connector.
Figure 2:
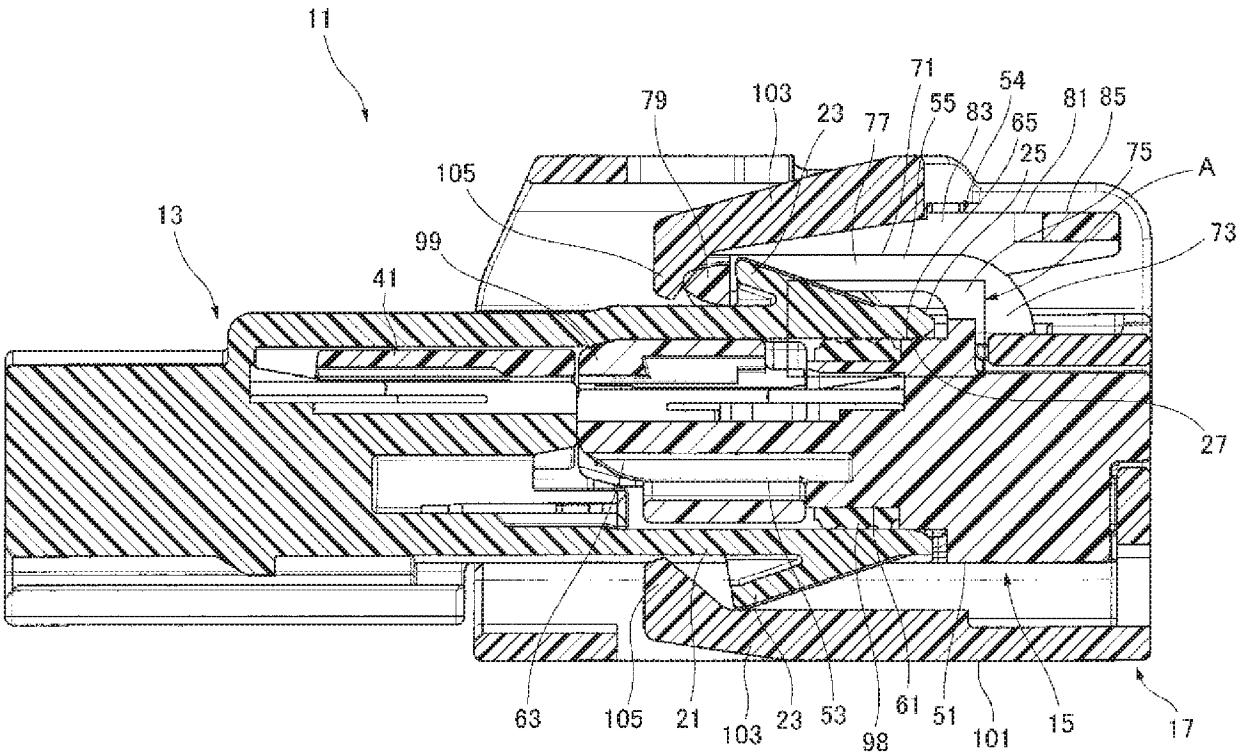
FIG. 2 is a cross-sectional view of the connector along a direction in which a male housing is fitted to the a female housing.

Hereinafter, exemplary embodiments of the present invention will be described in detail with reference to the drawings. FIG. 1 is an exploded perspective view of a connector. FIG. 2 is a cross-sectional view of the connector along a direction in which a male housing is fitted to a female housing.

As illustrated in FIGS. 1 and 2, a male housing (a housing) 13 according to an embodiment is configured to be fitted to a female housing (a mating housing) 15, thereby forming the connector 11 together with the female housing 15. The connector 11 includes a cylindrical CPA (a fitting assurance member) 17 slidable and to be attached from a rear side of the female housing 15. The male housing 13, the female housing 15, and the CPA 17 are each molded from a synthetic resin.

Figure 3:
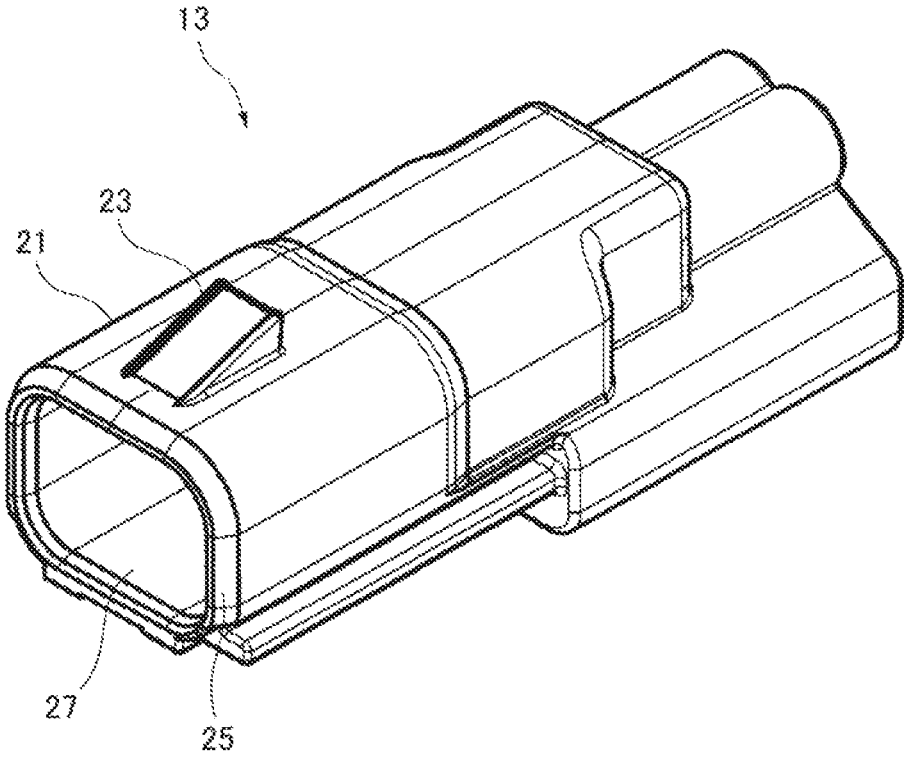
FIG. 3 is a perspective view of the male housing according to an embodiment.
Figure 4B:
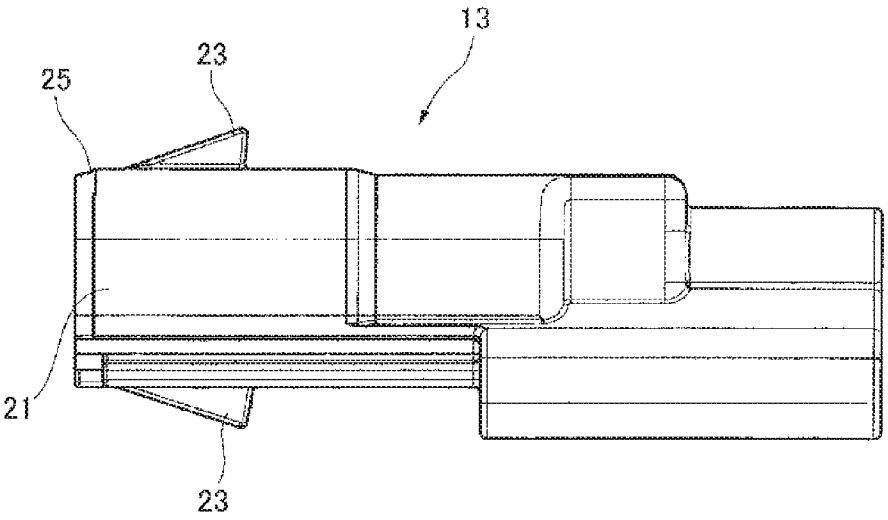
Figure 4A:
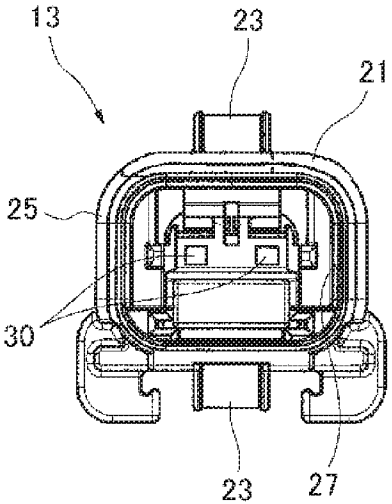

FIG. 3 is a perspective view of the male housing according to the present embodiment. FIGS. 4A and 4B illustrate the male housing according to the present embodiment, in which FIG. 4A is a front view, and FIG. 4B is a side view.

As illustrated in FIGS. 3, 4A and 4B, the male housing 13 according to the present embodiment includes a hood 21 on a distal end side, from which the male housing 13 is fitted to the female housing 15 (fitting side). Lock protrusions 23 are provided on upper and lower sides of the hood 21.

The hood 21 is formed in a cylindrical shape. A front end side of the hood 21 in the direction to which the male housing 13 is fitted to the female housing 15 is opened. A distal end on the front end side of the hood 21 is a cylindrical seal portion 25. On an inner peripheral surface of the cylindrical seal portion 25 is provided a sealing surface 27.

The male housing 13 includes two terminal housing chambers 30 at a rear side of the male housing 13 in the direction to which the male housing 13 is fitted to the female housing 15. As illustrated in FIG. 1, male terminals 33 to be connected to end portions of electric wires 31 are to be accommodated in the terminal housing chambers 30, and the electric wires 31 are to be drawn out from a rear end of the male housing 13. Rubber plugs 34 to be attached to the electric wires 31 are to be fitted into the terminal housing chambers 30 from a rear end side of the male housing 13. Accordingly, the terminal housing chambers 30 of the male housing 13 for accommodating the male terminals 33 are sealed water-tightly.

The male terminals 33 are made of, for example, a conductive metal material such as copper, a copper alloy, or the like, and are to be crimped to and to be connected to the electric wires 31. The male terminals 33 include tabs 35 each formed in a pin shape, and the tabs 35 are to be accommodated in the hood 21.

A front holder 41 and a short terminal 43 are to be attached to the male housing 13 from the front end side in the direction to which the male housing 13 is fitted to the female housing 15. The front holder 41 is made of a synthetic resin and is to be attached to the male housing 13, so that the male terminals 33 to be inserted and to be accommodated in the terminal housing chamber 30 are to be held in a state of being accommodated in the terminal housing chamber 30. The short terminal 43 is to be formed of, for example, a conductive metal material such as copper, a copper alloy, or the like. The short terminal 43 is to be attached to the male housing 13 so as to be in contact with the tabs 35 of the male terminals 33 when the female housing 15 is not fitted to the male housing 13. Accordingly, the male terminals 33 are to be electrically connected to each other by the short terminal 43. An interlock circuit is for example to be formed.

Figure 5:
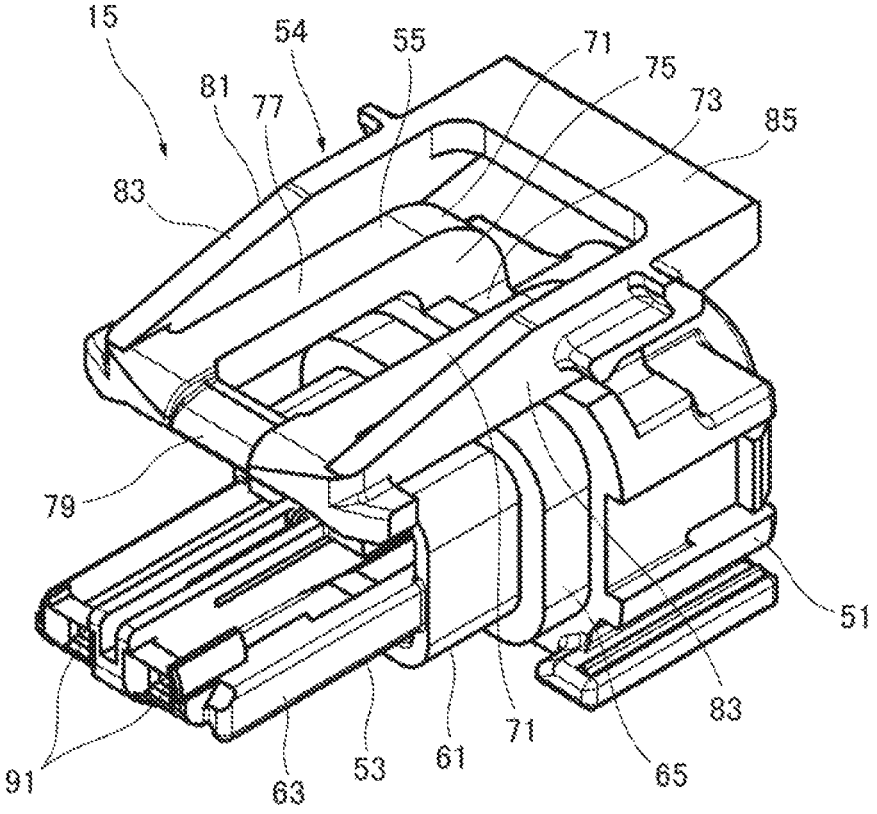
FIG. 5 is a perspective view of the female housing.
Figure 6B:
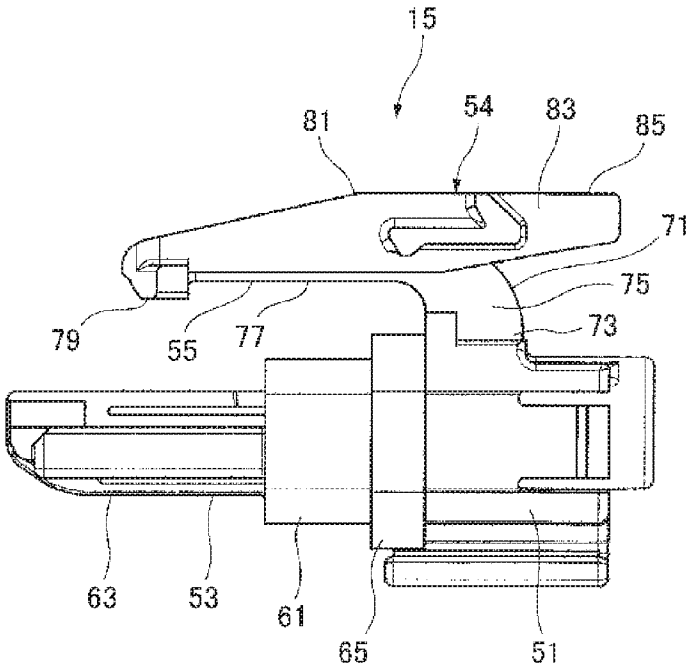
Figure 6A:
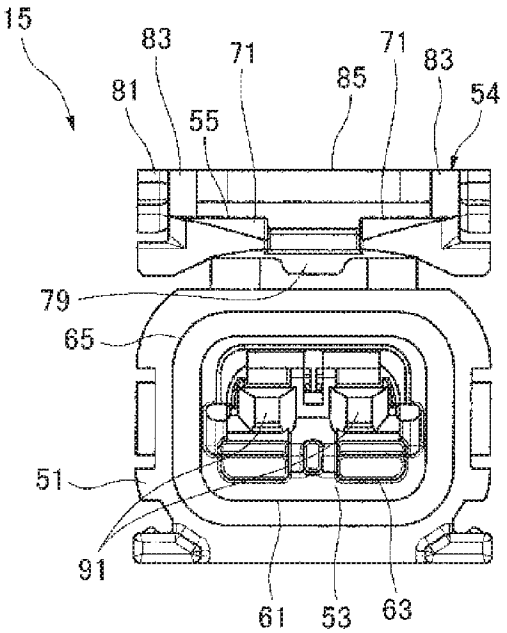

FIG. 5 is a perspective view of the female housing. FIGS. 6A and 6B illustrate the female housing, in which FIG. 6A is a front view, and FIG. 6B is a side view.

As illustrated in FIGS. 5, 6A and 6B, the female housing 15 includes a housing body 51, a fitting protrusion 53, and a lock mechanism 54. The fitting protrusion 53 protrudes forward from the housing body 51 in the direction in which the female housing 15 is fitted to the male housing 13. The fitting protrusion 53 is to be fitted into the hood 21 of the male housing 13. The fitting protrusion 53 includes a seal attachment portion 61 on one side of the fitting protrusion 53, the one side being connected to the housing body 51, and a terminal holding portion 63 on the other side of the fitting protrusion 53 opposite to the one side of the fitting protrusion 53. The terminal holding portion 63 protrudes forward from the seal attachment portion 61 in the direction to which the female housing 15 is fitted to the male housing 13. In the female housing 15, an edge of the housing body 51 connected to the fitting protrusion 53 is a fitting edge 65 having an outer shape larger than the seal attachment portion 61 of the fitting protrusion 53, i.e. the fitting edge 65 has larger outer circumference than the seal attachment portion 61.

The lock mechanism 54 is provided on the housing body 51 in the female housing 15. The lock mechanism 54 includes a lock arm 55 and a release arm 81. The lock arm 55 includes a pair of elastic arm portions 71. The elastic arm portion 71 includes a supporting post 73 provided on an upper surface of the housing body 51, a bent portion 75 bent forward from the supporting post 73, i.e. bent toward the male housing 13, and an extended portion 77 extending forward continuously from the bent portion 75. Distal ends of the extended portions 77 of the elastic arm portions 71 are connected to each other, and a connection portion at which the extended portions 77 are connected to each other is a lock portion 79. The lock arm 55 swings when the elastic arm portion 71 is elastically deformed.

The release arm 81 includes a pair of support arm portions 83 connected to distal ends of the elastic arm portions 71, the support arm portions 83 extending rearward, and an operation portion 85 connecting rear ends of the support arm portions 83. The support arm portion 83 extends to the rear side of the female housing 15 from the supporting post 73 of the elastic arm portion 71. Accordingly, the operation portion 85 is provided further in the rear side of the female housing 15 than the supporting post 73 of the elastic arm portion 71.

When the male housing 13 and the female housing 15 are fitted, the lock portion 79 of the lock arm 55 in the lock mechanism 54 is to lock the upper side lock protrusion 23 of the hood 21 of the male housing 13. Accordingly, the male housing 13 and the female housing 15 are locked in a state of being fitted to each other.

The female housing 15 is formed with two terminal housing chambers 91. As illustrated in FIG. 1, female terminals 95 connected to end portions of electric wires 93 are to be accommodated in the terminal housing chambers 91, and the electric wires 93 are to be drawn out from a rear end of the female housing 15. Rubber plugs 96 attached to the electric wires 93 are to be fitted into the terminal housing chambers 91 from a rear end side of the female housing 15. Accordingly, the terminal housing chambers 91 of the female housing 15 housing the female terminals 95 are to be sealed water-tightly.

A seal member 98 and a retainer 99 are to be attached to the female housing 15 from a front side of the female housing 15. The seal member 98 is formed of an elastic material such as rubber or the like, and is formed in an annular shape. The seal member 98 is to be attached to the seal attachment portion 61 of the fitting protrusion 53. The retainer 99 is made of a synthetic resin, and is to be attached to the terminal holding portion 63 of the fitting protrusion 53. The retainer 99 is to be attached to the terminal holding portion 63, so that the female terminal 95 to be inserted and to be accommodated in the terminal housing chamber 91 is to be held in a state of being accommodated in the terminal housing chamber 91.

As illustrated in FIGS. 1 and 2, the CPA 17 includes a body portion 101 to be formed in a rectangular cylindrical shape, and is to be attached to the female housing 15 so as to cover the female housing 15 from rear and to be slidable along the direction in which the female housing 15 is fitted to the male housing 13. The CPA 17 is to include engagement arms 103 at upper and lower sides of the body portion 101. The engagement arms 103 are supported by the body portion 101 in a cantilever manner, and engagement claws 105 protruding inward are provided at distal end portions of the engagement arms 103. When the CPA 17 is attached to the female housing 15, the engagement claw 105 of the upper side engagement arm 103 abuts against a rear portion of the lock portion 79 of the lock arm 55.

Next, how the male housing 13 and the female housing 15 are fitted to each other will be described. When the male housing 13 and the female housing 15 to which the CPA 17 is to be attached are fitted, the lock portion 79 is to be pressed forward in the direction in which the female housing 15 is fitted to the male housing 13 by the upper side engagement arm 103 of the CPA 17.

Then, when the lock portion 79 of the lock arm 55 gets over the upper side lock protrusion 23 of the hood 21 of the male housing 13, the male housing 13 and the female housing 15 are locked to each other in a fitted state. The engagement claw 105 of the upper side engagement arm 103 of the CPA 17 to be pushed forward in the direction in which the female housing 15 is fitted to the male housing 13 engages with the lock portion 79 of the lock arm 55 that is to lock the upper side lock protrusion 23 of the hood 21. Then, the engagement claw 105 of the lower side engagement arm 103 is to lock the lower side lock protrusion 23 of the hood 21. Accordingly, the CPA 17 is locked to the male housing 13 by the upper and lower side engagement arms 103, and the locking state of the lock protrusion 23 by the lock portion 79 of the lock arm 55 is to be maintained by the upper side engagement arm 103 of the CPA 17 to secure a fitting assurance state.

When the male housing 13 and the female housing 15 are fitted to each other, the fitting protrusion 53 of the female housing 15 to which the retainer 99 is attached is inserted into the hood 21 of the male housing 13. Accordingly, the short terminal 43 is pushed downward by the retainer 99 so as to be separated from the tab 35 of the male terminal 33, and a short-circuit state of the male terminal 33 is released. The tab 35 of the male terminal 33 is inserted into the female terminal 95, so that the male terminal 33 and the female terminal 95 are electrically connected to each other.

Figure 7:
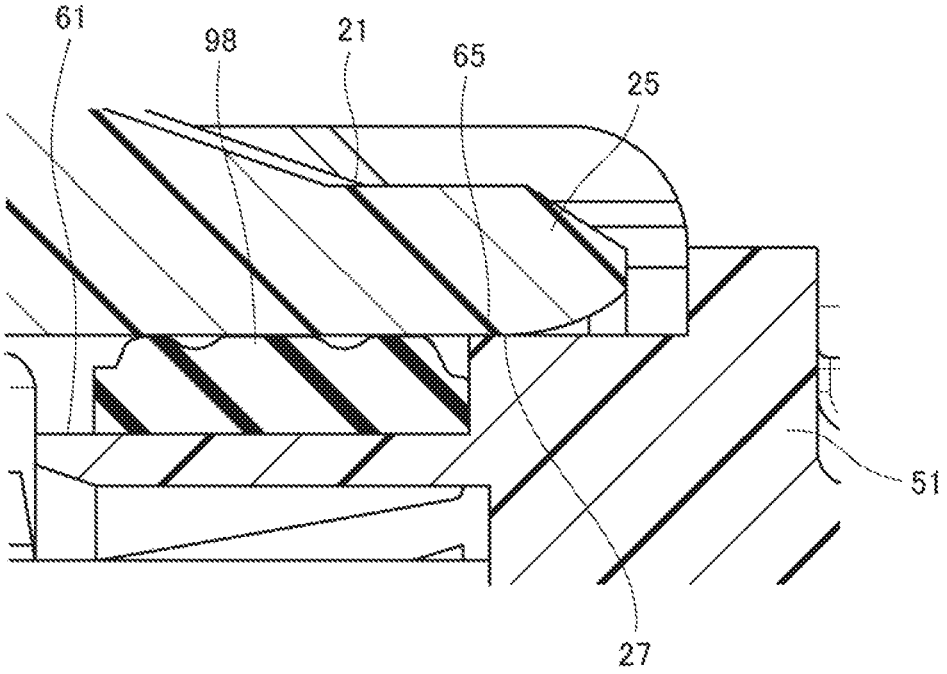
FIG. 7 is an enlarged view of a part A in FIG. 2.

Next, a sealing structure when the male housing 13 and the female housing 15 are fitted to each other will be described. FIG. 7 is an enlarged view of a part A in FIG. 2.

When the male housing 13 and the female housing 15 are fitted, the seal member 98 attached to the seal attachment portion 61 of the female housing 15 contacts an inner peripheral surface of the hood 21 of the male housing 13 in a pressed manner. Accordingly, a fitting portion at which the male housing 13 and the female housing 15 are fitted to each other is sealed (see FIG. 2).

The fitting edge 65 of the female housing 15 is fitted to the distal end of the hood 21 of the male housing 13. Accordingly, the fitting edge 65 of the female housing 15 is covered over an entire circumference of the filling edge 65 by the cylindrical seal portion 25 which is on the distal end side of the hood 21 of the male housing 13. As illustrated in FIG. 7, the sealing surface 27 of the cylindrical seal portion 25 contacts an outer peripheral surface of the fitting edge 65 without any gap.

Figure 8:
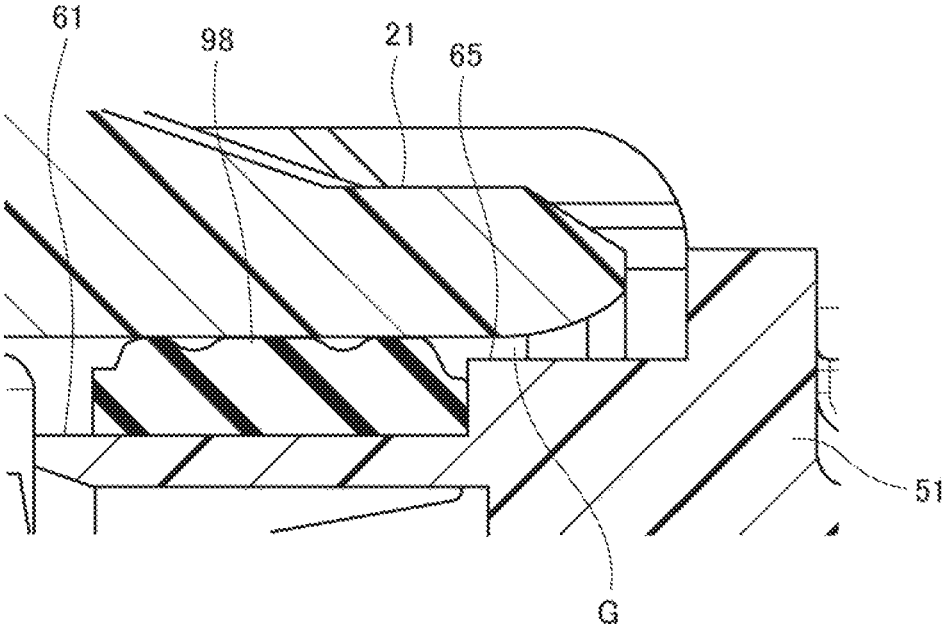
FIG. 8 is an enlarged view of a male housing according to a reference example that corresponds to the part A in FIG. 2.

Here, a reference example will be described. FIG. 8 is an enlarged view illustrating a male housing according to the reference example that corresponds to the part A in FIG. 2.

As illustrated in FIG. 8, in the reference example, a gap G is formed between the hood 21 and the fitting edge 65 of the female housing 15 in a state of being fitted to each other. Therefore, for example, when a vehicle is washed by a high pressure cleaner or the like, if water ejected at a high pressure from the high pressure cleaner hits the male housing 13 and the female housing 15 and enters the gap G between the hood 21 and the fitting edge 65 of the female housing 15, the inner seal member 98 will be damaged due to the water pressure. As a result, sealing performance may be reduced.

On the other hand, according to the present embodiment, when fitted to the female housing 15, the cylindrical seal portion 25 which is on the distal end side of the hood 21 having a cylindrical shape contacts the fitting edge 65 of the female housing 15 over the entire circumference of the fitting edge 65 thereby covering the fitting edge 65 without any gap between the hood 21 and the fitting edge 65. Accordingly, for example, even when water ejected from the high pressure cleaner hits the male housing 13 and the female housing 15, it is possible to prevent the water from entering a space inside which the seal member 98 is attached via a gap between the male housing 13 and the female housing 15. Therefore, it is possible to prevent the seal member 98 from being damaged, and to maintain good sealing performance. Furthermore, since the seal member 98 can be used to prevent water from entering further inside the housings, it is possible to simplify the seal member 98 and to reduce cost.

Figure 9:
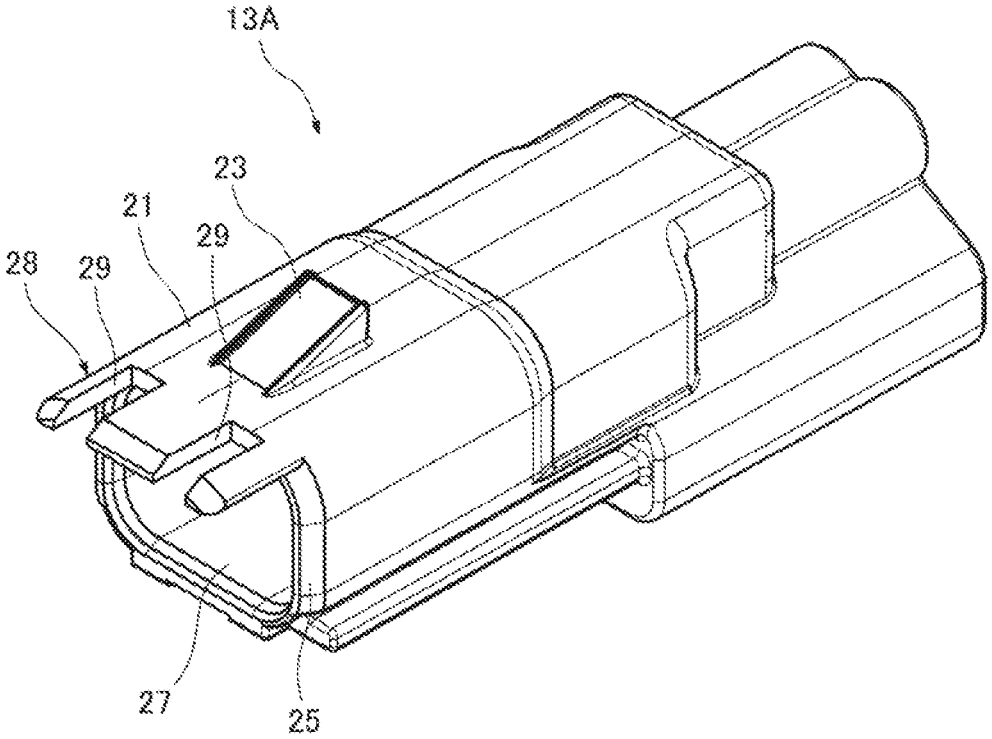
FIG. 9 is a perspective view of a male housing according to a modification.
Figure 10:
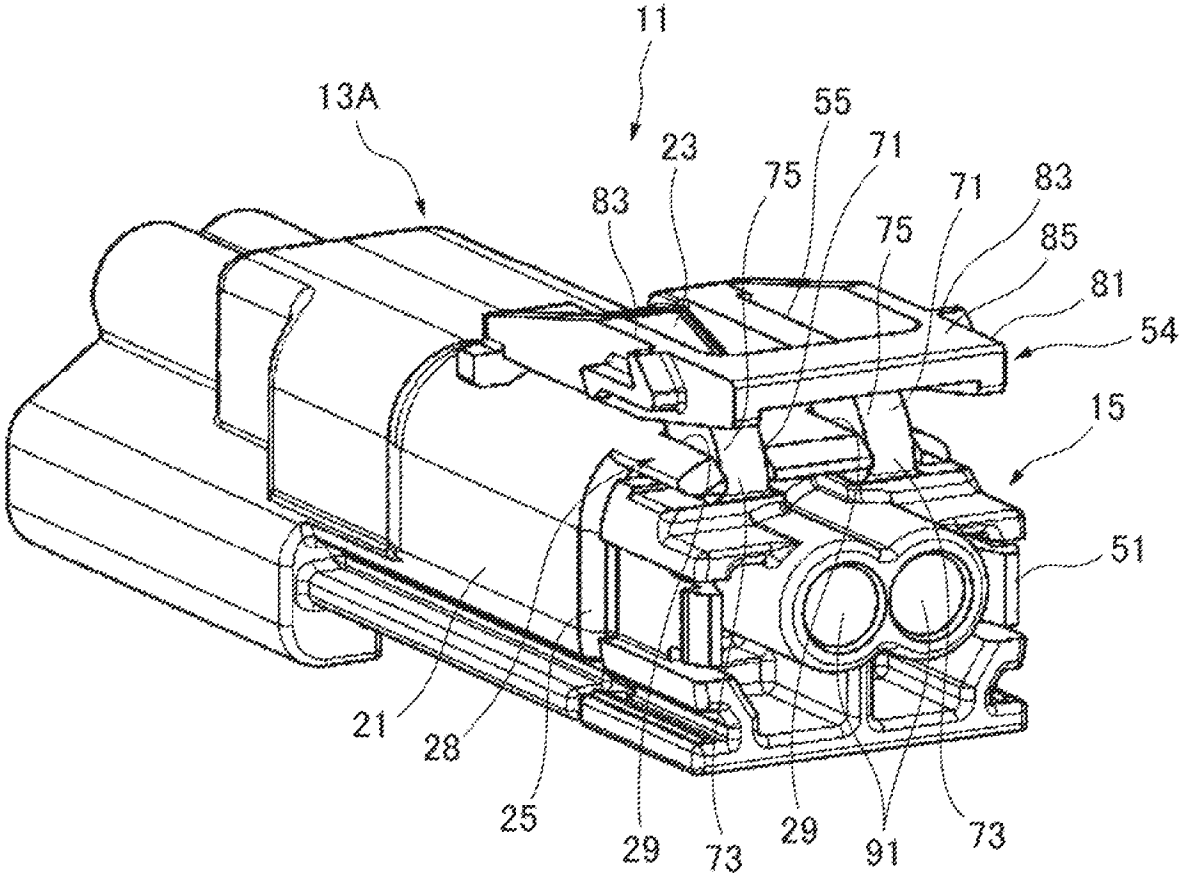
FIG. 10 is a perspective view of the connector as viewed from a female housing side of the connector.
Figure 11:
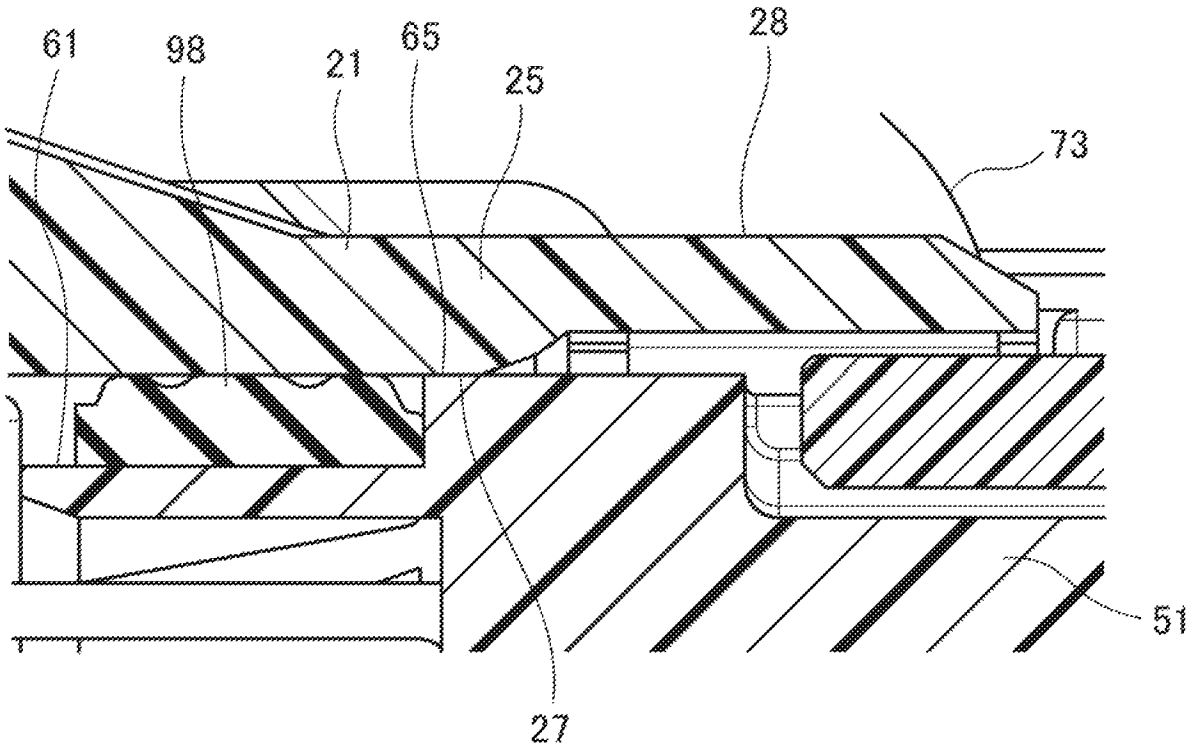
FIG. 11 is an enlarged view of the male housing according to the modification that corresponds to the part A in FIG. 2.

Next, a modification will be described. The same parts as those in the above-described embodiment are denoted by the same reference numerals, and descriptions thereof will be omitted. FIG. 9 is a perspective view of a male housing according to the modification. FIG. 10 is a perspective view of the connector as viewed from a female housing side of the connector. FIG. 11 is an enlarged view illustrating the male housing according to the modification that corresponds to the part A in FIG. 2.

As illustrated in FIG. 9, a male housing 13A according to the modification is provided with a cover extension 28. The cover extension 28 is provided at an upper part of the hood 21 of the male housing 13A, and extends forward in the direction in which the male housing 13 is fitted to the female housing 15. The cover extension 28 is provided with notches 29. Each of the notches 29 is provided at a location corresponding to respective one of the supporting posts 73 of the elastic arm portions 71 provided on the lock arm 55 of the female housing 15.

As illustrated in FIG. 10, when the male housing 13A is fitted to the female housing 15, the supporting posts 73 of the lock arm 55 enters the notches 29, and the cover extension 28 of the hood 21 is inserted toward a base of the lock arm 55 of the female housing 15.

Accordingly, as illustrated in FIG. 11, the base of the lock arm 55 of the female housing 15 is covered by the cover extension 28 of the male housing 13A. Therefore, the male housing 13A and the female housing 15 are sealed by the cylindrical seal portion 25 that is in contact with the fitting edge 65 over the entire circumference with the cover extension 28 covering the base of the lock arm 55.

As described above, according to the male housing 13A in the modification, the cover extension 28 of the male housing 13A covers the base of the lock arm 55 of the female housing 15. Therefore, it is possible to more effectively seal the fitting portion sealed by the cylindrical seal portion 25 that is in contact with the fitting edge 65 over the entire circumference.

That is, the cover extension 28 protect the portion at which the male housing 13A and the female housing 15 are connected to each other from water ejected from a high water pressure cleaner, thereby preventing the water from entering between the male housing 13A and the female housing 15, so that it is possible to more effectively seal the connected portion between the male housing 13A and the female housing 15.

The cover extension 28 is inserted toward the base of the lock arm 55, and the supporting posts 73 of the lock arm 55 enters the notches 29. Accordingly, by virtue of the cover extension 28, it is possible to improve sealing performance in the vicinity of the base of the lock arm 55, which is difficult to be sealed due to provision of the lock arm 55. By virtue of the cover extension 28 being inserted toward the base of the lock arm 55, it is also possible to protect the base of the lock arm 55, and to prevent rattling between the male housing 13A and the female housing 15 being fitted to each other.

While the present invention has been described with reference to certain exemplary embodiments thereof the scope of the present invention is not limited to the exemplary embodiments described above, and it will be understood by those skilled in the art that various changes and modifications may be made therein without departing from the scope of the present invention as defined by the appended claims.

According to an aspect of the embodiments described above, a housing (a male housing 13) configured to be fitted to a mating housing (a female housing 15), the housing (the male housing 13) including a cylindrical hood (21) into which a fitting protrusion (53) of the mating housing (the female housing 15) is finable, the cylindrical hood (21) being configured such that, when the fitting protrusion (53) is fitted into the cylindrical hood (21), a space between the cylindrical hood (21) and the fitting protrusion (53) is sealed with an annular seal member (98) provided on the fitting protrusion (53). The cylindrical hood (21) includes, at a distal end of the cylindrical hood (21) from which the housing (the male housing 13) is fitted to the mating housing (the female housing 15), a cylindrical seal portion (25)

configured to contact, when the fitting protrusion (53) is fitted into the cylindrical hood (21), an edge (a fitting edge 65) of the mating housing (the female housing 15) continuously over an entire circumference of the edge (the fitting edge 65) and to cover the edge (the fitting edge 65) between the cylindrical seal portion (25) and the edge (the fitting edge 65).

According to the housing having the above-described configuration, when fitted to the mating housing, the cylindrical seal portion, which is the distal end of the cylindrical hood, contacts the edge of the mating housing over the circumferential direction to cover the edge without any gap between the cylindrical seal portion and the edge. Accordingly, for example, even when water ejected from the high pressure cleaner hits the housing and the mating housing, it is possible to prevent the water from entering a space inside which the seal member is attached via a gap between the housing and the mating housing. Therefore, it is possible to prevent the seal member from being damaged and to maintain the good sealing performance. The water is prevented from entering the seal portion by the seal member, so that it is possible to simplify the seal member to reduce cost.

The housing may further include a cover extension (28) extending from the cylindrical seal portion (25) in a direction in which the housing (the male housing 13) is fitted to the mating housing (the female housing 15).

According to the housing having the above-described configuration, the cover extension prevents water from hitting the portion at which the housing and the mating housing are connected to each other, the cover extension extending toward the mating housing from the cylindrical seal portion in the direction in which the housing is fitted to the mating housing. Accordingly, it is possible to seal the space between the housing and the mating housing more effectively.

The cover extension (28) may include a notch (29) at a location corresponding to a supporting post (73) of a lock arm (55), the lock arm (55) being provided as a part of the mating housing (the female housing 15) to lock the cylindrical hood (21) when the housing (the male housing 13) is fitted to the mating housing (the female housing 15).

According to the housing having the above-described configuration, the cover extension is fitted with the mating housing and the cover extension is inserted toward the base of the lock arm, and the lock arm enters the notch. Accordingly, by virtue of the cover extension, it is possible to improve sealing performance in the vicinity of the base of the lock arm which is difficult to be sealed due to provision of the lock arm. By virtue of the cover extension being inserted toward the base of the lock arm, it is also possible to protect the base of the lock arm, and to prevent rattling between the housing and the mating housing being fated to each other.

What is claimed is:

1. A housing configured to be fitted to a mating housing, the housing comprising:

a cylindrical hood into which a fitting protrusion of the mating housing is fittable, the cylindrical hood being configured such that, when the fitting protrusion is fitted into the cylindrical hood, a space between the cylindrical hood and the fitting protrusion is sealed with an annular seal member provided on the fitting protrusion, wherein the cylindrical hood comprises, at a distal end of the cylindrical hood from which the housing is fitted to the mating housing, a cylindrical seal portion configured to contact, when the fitting protrusion is fitted into the cylindrical hood, an edge of the mating housing continuously over an entire circumference of the edge and to cover the edge, and wherein the housing further comprises a cover extension extending from the cylindrical seal portion in a direction in which the housing is fitted to the mating housing.

2. The housing according to claim 1, wherein the cover extension comprises a notch at a location corresponding to a supporting post of a lock arm, the lock arm being provided as a part of the mating housing to lock the cylindrical hood when the housing is fitted to the mating housing.

* * * * *